US005660966A

United States Patent [19]

Willems et al.

[11] Patent Number: 5,660,966

[45] Date of Patent: Aug. 26, 1997

[54] MATERIAL FOR INDUSTRIAL RADIOGRAPHY AND DEVELOPMENT METHOD THEREOF

[75] Inventors: Peter Willems, Stekene; Freddy Henderickx, Olen, both of Belgium

[73] Assignee: Agfa-Gevaert, N.V., Mortsel, Belgium

[21] Appl. No.: 680,405

[22] Filed: Jul. 15, 1996

[30] Foreign Application Priority Data

Jul. 18, 1995 [EP] European Pat. Off. ..... 95201971

[51] Int. Cl.$^6$ ..... G03C 5/16

[52] U.S. Cl. ..... 430/139; 430/448; 430/566

[58] Field of Search ..... 430/139, 448, 430/566

[56] References Cited

U.S. PATENT DOCUMENTS 5,578,411 11/1996 Slater ..... 430/139

*Primary Examiner*—Hoa Van Le

*Attorney, Agent, or Firm*—Breiner & Breiner

[57] ABSTRACT

A silver halide photographic material for industrial radiography is disclosed comprising a film support and on one or both sides thereof at least one silver halide emulsion layer which is characterized in that each gelatino silver halide emulsion layer comprises as silver halide silver chloride or silver chlorobromide wherein the amount of bromide is not more than 10 mole %; has a gelatin to silver halide (expressed as silver nitrate) ratio from 0.2 to 0.6 and a total amount of silver halide corresponding to from 11 g to 35 g of silver/m$^2$ and in that the photographic material has been fore-hardened to such an extent that when it is immersed in demineralized water of 25° C. for 3 minutes there is not absorbed more than 3.0 g of water per gram of gelatin, and wherein said material further comprises a dihydroxybenzene compound and a 3-pyrazolidine-1-one compound as developing agents. Moreover a method for developing a radiographically exposed photographic material is disclosed comprising the step of contacting the exposed photographic material with an aqueous alkaline liquid, called activator liquid, being initially substantially free from developing agent(s), having a pH value of at least 10 and containing a primary and/or secondary amine.

10 Claims, No Drawings

MATERIAL FOR INDUSTRIAL RADIOGRAPHY AND DEVELOPMENT METHOD THEREOF

DESCRIPTION

1. Field of the Invention

The present invention relates to silver halide photographic materials for industrial radiography and to a method of processing said materials.

2. Background of the Invention

In normal processing of exposed silver halide photographic materials the various processing steps are carried out at ambient temperature (20°–25° C.) and require a relatively long time of several minutes. Therefore, there is a general trend to enhance the speed of processing especially in the field of radiography wherein often a very rapid access to the radiograph, whether for medical or industrial purposes, is required in diagnosis. Processing times less than 90 seconds are possible by increasing the processing temperature but require specially hardened emulsion layers in order to have sufficient resistance to abrasion in machine processing wherein the silver halide photographic material is led between conveyor rollers. Moreover, higher temperatures accelerate aerial oxidation of the developing agents so that developing baths without special protection measures against the oxygen of the air, become rapidly exhausted and cause stain. Further, higher temperatures than the ambient require a certain input of energy which makes high temperature processing less economical.

In most of the commercial materials for industrial radiography the silver halide emulsions are of the silver bromide type containing minor amounts of silver iodide [ref. "Radiographic Processing" by D. H. O. John—Focal Press—London—New York (1967), p. 82]. The use of more rapidly developing emulsion crystals rich in silver chloride instead of silver bromide in medical X-ray materials has been described in GB-P 907,023, in EP-A 0 678 772 and in EP-A 682 287, whereas for industrial non-destructive testing materials it has been disclosed in EP-A 538 947 and the corresponding U.S. Pat. No. 5,397,687.

In addition to the temperature the alkalinity of the developer plays a major role in rapid access processing and is normally situated in a pH range of from 10 to 12. The higher the alkalinity the faster the development proceeds but also the more rapidly the developer is oxidized by the air.

In order to avoid the disadvantages of normal development with the developing agent(s) in the alkaline developing solution so-called activation processing has been introduced.

Activation processing is applied e.g. in combination with rapid access stabilization as has been described in U.S. Pat. Nos. 4,030,924 and in 4,810,623. In activation processing use is made of silver halide photographic materials containing already before image-wise exposure one or more developing agents in their composition e.g. in a hydrophilic colloid layer adjacent to a gelatino silver halide emulsion layer. The processing bath used in an activation development of the latent silver image is an aqueous alkaline solution being free from any developing agent.

On the other hand as ecology is becoming more and more important the choice for customer-and environmental-friendly compositions of the so-called "activation materials" and of "activation processing liquid" becomes more and more stringent. Especially for industrial radiographic applications with direct-X-ray exposures, layer compositions have hitherto not been described.

OBJECTS OF THE INVENTION

Therefor it is a first object of this invention to provide a silver halide photographic film material for industrial radiography which has a satisfactory photographic performance even in activation processing i.e. rapid access performance with the required sensitometric characteristics.

A second object of this invention is to provide a material being acceptably customer-friendly and evironmental-friendly, having a layer composition that is fully in accordance with those two demands.

A third object of this invention is to provide a material maintaining an excellent image quality, especially image sharpness, and good physical properties.

Other objects will become apparent from the description hereinafter.

SUMMARY OF THE INVENTION

The above objects are accomplished by providing a silver halide photographic material for industrial radiography comprising a film support and on one or both sides thereof at least one gelatino silver halide emulsion layer which is characterized in that each gelatino silver halide emulsion layer comprises as silver halide silver chloride or silver chlorobromide wherein the amount of bromide is not more than 10 mole %; has a gelatin to silver halide (expressed as the equivalent amount of silver nitrate) ratio from 0.2 to 0.6 and a total amount of silver halide coated from 11 g to 35 g per $m^2$ and in that the said photographic material has been fore-hardened to such an extent that when it is immersed in demineralized water of 25° C. for 3 minutes there is not absorbed more than 3.0 g of water per gram of gelatin, wherein said material further comprises a dihydroxybenzene compound and a 3-pyrazolidine-1-one compound as developing agents.

A method is further disclosed for developing a radiographically exposed silver halide photographic material as set forth hereinbefore, comprising the steps of contacting the radiographically exposed photographic material with an aqueous alkaline liquid, called activator liquid, being initially substantially free from developing agent(s), having a pH value of at least 10 and containing a primary and/or secondary amine.

DETAILED DESCRIPTION OF THE INVENTION

By "initially substantially free" is meant that an amount not more than 0.014 mole of developing agent(s) is present in said alkaline aqueous liquid at the start of the development.

The development preferably proceeds at a pH in the range from 10 to 14, and more preferably in the range from 12 to 14. In said pH range developing agents e.g. hydroquinone, present in an amount higher than defined above yield strongly colorized developing baths by oxidation with oxygen of the air.

The contacting of the photographic material with an alkaline solution may proceed by any contacting technique known in the art, e.g. by dipping, meniscus coating, spraying or pod processing. It may proceed manually or automatically in a developing apparatus known to those skilled in the art.

According to a special embodiment the alkalinity of the developer solution is partly obtained by the above defined amines and an alkali-releasing agent consisting of a sodium or potassium salt e.g. sodium citrate, which reacts with a very slightly water-soluble metal hydroxide e.g. zinc hydroxide, as described e.g. in U.S. Pat. No. 3,260,598.

Preferred amines for use according to the present invention are aliphatic primary diamines and primary or secondary alkanol amines combining the characteristics of development accelerator, reproducibility and the absence of unpleasant smell as has been described in GB-P 1,469,763 and DE-OS 3,533,449; containing an alkylene chain of not more than 3 carbon atoms as e.g.

$H_2N—CH_2—CH_2—NH_2$ $H_3C—HN—CH_2—CH_2—OH$ $NH_2—CH_2CH_2OH$ $(CH_3)_2—CH—NH_2$

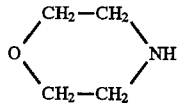

$H_2N—(CH_2CH_2NH)_3—CH_2—CH_2—NH_2$ $NH_2—(CH_2)_3—NH(CH_2)_2—OH$, and $NH(CH_2CH_2OH)_2$.

The amines used in the method of the present invention are applied in the activator liquid in a preferred concentration in the range of from 0.1 g/l to 100 g/l.

Apart from said amines the activator liquid used in the method of the present invention contains the necessary alkali e.g. sodium hydroxide, to obtain a pH in the range of 12 to 14 and some amount of anti-oxidising agent e.g. a sulphite to protect the amines against aerial oxidation.

The developing agent(s) may be present in the silver halide emulsion layer(s) of the silver halide photographic material but are preferably present in a hydrophilic colloid layer in waterpermeable relationship therewith e.g. in a covering layer serving as antistress or protective overcoat layer or in an antihalation layer adjacent to a silver halide emulsion layer of the photographic material and situated more close to the support.

In a preferred embodiment a mixture of developing agents including a dihydroxybenzene and a 3-pyrazolidine-1-one developing agent is used. These developing agents are used preferably in a respective molar ratio of 2/1 to 10/1. The dihydroxybenzene is preferably present in an amount of from 0.05 to 0.5 g for a coverage of silver halide equivalent with 1 g of silver nitrate.

A preferred dihydroxybenzene for use in a photographic material according to the invention is the p-hydroxybenzene compound p-hydroquinone.

3-Pyrazolidine-1-one developing compounds that are useful as auxiliary developing agents in a photographic material developed according to the present invention are within the scope of the following general formula:

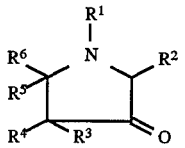

wherein:

$R^1$ represents an aryl group including a substituted aryl group e.g. phenyl, m-toluyl and p-toluyl, $R^2$ represents hydrogen, a lower ($C_1$–$C_3$) alkyl group e.g. methyl, or an acyl group e.g. acetyl, each of $R^3$, $R^4$, $R^5$ and $R^6$ (which may be the same or different) represents hydrogen, an alkyl group, preferably a $C_1$–$C_5$ alkyl group including a substituted alkyl group, or an aryl group including a substituted aryl group.

1-Aryl-3-pyrazolidinone compounds within the scope of the above formula and suitable for use according to the present invention are known e.g. from the GB-P 1,093,177 filed Dec. 16, 1964 by Gevaert Photo-producten N.V.

Examples thereof are:

1-phenyl-3-pyrazolidine-1-one also known as "phenidone"
1-(m-tolyl)-3-pyrazolidinone
1-phenyl-4-methyl-3-pyrazolidinone
1-phenyl-5-methyl-3-pyrazolidinone
1-phenyl-4,4-dimethyl-3-pyrazolidinone
1,5-diphenyl-3-pyrazolidinone
1-(m-tolyl)-5-phenyl-3-pyrazolidinone
1-(p-tolyl)-5-phenyl-3-pyrazolidinone and mixtures thereof.

The silver halide emulsion layer(s) of a photographic material developed according to the present invention preferably contain gelatin as a hydrophilic binding agent. However, the gelatin may be partly replaced by other natural and/or synthetic hydrophilic colloids e.g. albumin, casein or zein, polyvinyl alcohol, alginic acids, cellulose derivatives such as carboxymethylcellulose and modified gelatin.

The ratio by weight of hydrophilic colloid binder to silver halide, expressed as an equivalent amount of silver nitrate, in the silver halide emulsion layer(s) of the photographic material developed according to the method of the present invention is preferably in the range of from 0.3 up to 1.0, more preferably up to 0.8, and still more preferably up to 0.6 in order to provide a shorter drying time.

In addition to the binder, silver halide and developing agent(s) the silver halide photographic material may contain in the light-sensitive emulsion layer(s) and/or in one or more layers in water-permeable relationship with the silver halide emulsion layer(s) any of the kinds of compounds customarily used in such layers for improving the photographic process, manufacture or keepability (storage). For example such layers may incorporate one or more coating aids, stabilising agents or antifogging agents as described e.g. in GB-P 1,007,020 filed Mar. 6, 1963 by Agfa A. G., plasticizers, development-modifying agents as e.g. polyoxyalkylene compounds, onium compounds, and sulphur compounds of the class which have sulphur covalently bound derived from an ion such as a mercaptide or xanthate or coordinately bound sulphur from a thioether. Preferably thioethers acting as silver chelating agents with at least two sulphur atoms as donors are used. A survey of thioether compounds suitable for incorporation in silver halide emulsion layers of widely varying silver halide composition has been given in the EP-A 0 026 520.

The silver halide emulsion crystals rich in silver chloride, contained in the photographic material, incorporating at least one developing agent preferably has a grain size of least at 0.15 μm, up to at most 1.2 μm, more preferably up to 1.0 μm and still more preferably up to 0.8 μm.

For the preparation of gelatino silver chloride or chlorobromide emulsions used the material in accordance with the present invention conventional lime-treated or acid treated gelatin can be used. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966). Before and during the formation of the silver halide grains the gelatin concentration is kept from about 0.05% to 5.0% by weight in the dispersion medium. Additional gelatin is added in a later stage of the emulsion preparation e.g. after washing, to establish optimal coating conditions and/or to establish the required thickness of the coated emulsion layer. The gelatin to silver halide ratio then ranges from 0.3 to 0.6. Although the precipitation in connection with the present invention can be principally performed by one double jet step, it is preferred to perform a sequence of a nucleation step and at least one growth step. Of the total silver halide precipitated preferably 0.5% to 5.0% is added during said nucleation step which consists preferably of an approximately equimolecular addition of silver and halide salts. The rest of the silver and halide salts is added during one or more consecutive double jet growth steps. The different steps of the precipitation can be alternated by physical ripening steps. During the growth step(s) an increasing flow rate of silver and halide solutions is preferably established e.g. a linearly increasing flow rate. Typically the flow rate at the end is about 3 to 5 times greater then at the start of the growth step. These flow rates can be monitored by e.g. magnetic valves. There can be a homogeneous distribution of the silver halide used over the whole volume of the silver halide crystals, for which the composition of the halide solution remains unchanged during the whole precipitation. However, a core-shell or multistructure emulsion can be used wherefore the composition of the halide solutions is varied during the growth stage. The moment at which this change has to take place depends on the desired thickness of the core and the shell and on the amounts and the ratio of chloride to bromide ions that are built into the crystals. Within the scope of this invention an amount of not more than 10 mol % of bromide ions may be built into the silver halide crystals, whether it is built in homogeneously or, as is the case for core-shell emulsions, heterogeneously. In order to get a homogeneous silver halide crystal distribution after precipitation it is recommended that before the start and during the different stages of the precipitation the pAg is maintained between 105 and 85 mV vs. a calomel electrode, used as a reference electrode, during the nucleation step and preferably between 90 and 65 mV during the growth phase and pH is maintained between 5.2 and 5.8 preferably between 5.6 and 5.8. When using conventional precipitation conditions silver halide emulsion grains rich in chloride show a cubic morphology with (100) crystal faces offering better developing characteristics than other crystallographic forms, as e.g. octahedral, rhombic dodecahedral or tabular silver chloride crystals, which require the use of so-called "growth modifiers" or "crystal habit modifiers". However, emulsions rich in silver chloride having crystallographic form other than cubic can be used.

After completion of the precipitation a wash technique in order to remove the excess of soluble salts is applied at a pH value which can vary during washing but remains comprised between 3.7 and 3.3 making use of a flocculating agent like polystyrene sulphonic acid. Normally the emulsion is washed by diafiltration by means of a semipermeable membrane, also called ultrafiltration, so that it is not necessary to use polymeric flocculating agents that may disturb the coating composition stability before, during or after the coating procedure. Such procedures are disclosed e.g. in Research Disclosure Vol. 102, October 1972, Item 10208, Research Disclosure Vol. 131, March, Item 13122 and Mignot U.S. Pat. No. 4,334,012. Preferably, at the start of the ultrafiltration, there is no pH and pAg adjustment; pH and pAg are the same as at the end of the preceding precipitation without any adjustment stage.

The silver halide emulsions coated in the gelatino silver halide layers of the industrial radiographic materials of the present invention may be chemically sensitised as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in the cited literature chemical sensitization may be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners or by means of reductors e.g. tin compounds as described in GB 789,823, amines, hydrazine derivatives, formamidine-sulphinic acids, etc.

The silver halide emulsion layer(s) of the materials in accordance with the present invention or the non-light-sensitive layers may comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion at any stage of the emulsion preparation. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercaptotetrazole, mercaptopyrimidines, mercaptotriazines, benzothiazoline-2-thione, oxazolinethione, triazaindenes, tetrazaindenes and pentazaindenes, especially those described by Birr in Z. Wiss. Phot. 47 (1952), pages 2–58, triazolopyrimidines such as those described in GB 1,203,757, GB 1,209,146, JA-A 75-39537, and GB 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide.

The gelatin binder of the photographic elements according to the present invention can be hardened with appropriate hardening agents such as those of the epoxide type, those of the ethylenimine type, those of the vinylsulfone type e.g. 1,3-vinylsulphonyl-2-propanol, aldehydes e.g. formaldehyde, glyoxal, and glutaric aldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

Hardening is to such an extent that when the photographic material is immersed in demineralized water of 25° C. at most 3.0 g of water is absorbed per gram of gelatin in 3 minutes. In order to get such a low absorption amount of water the amount of gelatin in the emulsion layer has to be decreased as there may otherwise be a problem with sticking. Indeed due to the incorporation of developing agents the degree hardening of the layers decreases. To avoid this extra gelatin should be added to the coating layers. An acceptable compromise can be attained by leaving the amount of gelatin in the activation layer unchanged and by lowering the said amount in the emulsion layer or layers.

The support for the light-sensitive silver halide emulsion layer(s) may be any opaque or transparent support customarily employed in the art.

Transparent supports are usually made of organic resins e.g. polyethylene terephthalate or polyethylene naphthalate, whereas opaque supports are usually made of paper either or not coated with a water-impermeable layer of e.g. a polyolefine such as polyethylene. The support of the photographic material in accordance with the present invention may be a transparent resin, preferably a blue colored polyester support like polyethylene terephtalate. The thickness of such organic resin film is preferably about 175 μm. The support is provided with a substrate layer at both sides to have good adhesion properties between the most adjacent emulsion layer and said support.

The photographic material according to the present invention is preferably a duplitized material having on both sides of the film support at least one emulsion layer. Both emulsion layers are overcoated with a protective antistress topcoat layer.

The photographic material can be image-wise exposed by means of an X-ray radiation source the energy of which, expressed in kV, depends on the specific application. Another typical radiation source is a radioactive $Co^{60}$ source. To reduce the effect of scattering radiation a metal filter, usually a lead filter, is used in combination with the silver halide photographic film.

Ecologic advantages of the system according to this invention are related with the low amount of processing liquids that are consumed: the activator bath should only be replenished as a consequence of evaporation and "cross-over". Amounts of about 50 to 75 ml per square meter are sufficient as there is a low crossover thanks to the low amount of water absorption of the activation material. Fixer regeneration amounts can be further reduced by means of electrolysis. A further advance of low crossover amounts of activator means that also lower amounts of washing water are required.

To summarize: a reduction in processing time means a high capacity. A total processing time of about 90 seconds is attainable with approximately an activating time of 10 s, a fixing time of 20 s, a washing time of 20 s and a drying time of 40 s. If compared with the conventional processing times as described in e.g. EP-A 0 538 947 a reduction with a factor of about 2 can be attained.

Moreover a reduction with a factor of at least 3 can be attained if a comparison is made with materials comprising silver bromide or silver bromoiodide emulsion crystals.

The present invention is illustrated by the following example without however being limited thereto. All parts, percentages and ratios are by weight unless otherwise indicated.

EXAMPLE

General Preparation of the Photographic Material

1. Emulsion Preparation.

A silver halide emulsion rich in chloride was prepared by a double jet technique. The silver halide composition was 98 mole % of chloride and 2 mole % of bromide and the average grain size was 0.40 μm using methionin as a growth accelerator in an amount of 12 g per 2.11 starting volume in the vessel, containing 90 g of inert gelatin and 40 mmoles of sodium chloride at 60° C. Concentrated solutions of 11 of $AgNO_3$ and NaCl/KBr 98/2, 2.94N each, were run with the double jet technique in the vessel in a total time of 3 minutes for the $AgNO_3$ solution and in 2 minutes and 45 seconds for the mixed halide solution. After physical ripening during 12 minutes at 60° C., 100 ml of a solution of KI (1% by weight) was added. 5 minutes later toluene thiosulphonic acid was added in an amount of 3.5 mg, followed by the addition of gold in an amount of 7.3 μmole one minute later. After a digestion time of 20 minutes another 90 ml of a solution of KI (1% by weight) was added, followed after 5 minutes by 1-phenyl-5-mercaptotetrazole, which was added as a stabilizer in an amount 150 mg.

After this ripening step, performed in the reaction vessel, without the presence of thiosulphate ions, the flocculation procedure could begin: pH was adjusted at a value of 3.3 with sulphuric acid, 3M, and 10 g of polystyrene sulphonic acid was added slowly in 2 minutes. The washing procedure was performed in a discontinous way, adding 3.5 1 of demineralized water. After sedimentation of the flocculate and decantation this washing procedure was still repeated three times. After addition of inert gelatin to a ratio of gelatin to silver nitrate in the emulsion of about 0.5, the emulsion was peptized and phenol was added as a biocide.

2. Coating Compositions

A silver halide photographic material was prepared having on a subbed polyester base a gelatino-silver halide emulsion of which the silver halide consists for 98 mole % of silver chloride and 2 mole % of bromide having an average grain size of 0.30 μm the preparation of which has been described above. A coated amount of silver, expressed as the equivalent amount of silver nitrate of 10.5 g per square meter, and a gelatin to silver chloride (expressed in equivalent amount of silver nitrate) ratio of 0.36 was provided with a gelatin covering layer (protective anti-stress layer) containing 0.26 g of hydroquinone and 0.11 g of dimethylphenidone in 1.40 g of gelatin per $m^2$.

Moreover an interlayer having 4 g of gelatin per $m^2$ was coated between the subbing layer and the emulsion layer, said interlayer containing 0.8 g of hydroquinone and 0.11 g of dimethylphenidone per $m^2$.

The layers containing gelatin were hardened with formaldehyde to improve their mechanical strenght (amounts of water absorption: see Table 1).

The thus obtained silver halide photographic material was exposed through a stepwedge and was processed in successive order with an aqueous activation liquid, fixing liquid and rinsing liquid as defined hereinafter. The treatment in each liquid had a duration of 10 seconds at a temperature of 22° C.

3. Exposure Conditions

The coated and dried films were exposed with a 86 kV, resp. 235 kV X-ray radiation source placed at a distance of 1.50 m and in contact with a copper filter with a thickness of 1 mm (indicated as exposure A in the further examples) or with a 235 kV radiation source placed at a distance of 1.50 m in contact with a copper filter of 8 mm thickness (indicated as exposure B).

4. Composition of the Activation Liquid "FA 12" (Per liter)

| | |
|---|---|
| potassium hydroxide | 50 g |
| potassium sulphite | 60 g |
| potassium bromide | 2 g |
| ethylene diamine | 2 ml |

5. Composition of the Fixing Liquid (Per Liter)

| | |
|---|---|
| ammonium thiosulphate | 100 g |
| sodium sulphite | 17 g |
| sodium acetate | 15 g |
| citric acid | 2.5 g |
| acetic acid | 13 ml |

The rinsing liquid was distilled water.

Tables 1 and 2 contain a survey of the obtained sensitometric data (fog, the density of the support comprised therein, speed (log K) at a density D of 2.0 above fog and the average gradient G between a density D of 1.5 and 3.5, both above fog).

Further on data are summarised for a radiation exposure of 235 kV (Table 1) and 86 kV (Table 2) respectively for freshly prepared materials and for materials stored for 36 hours at 57° C. and 34% RH (relative humidity).

Moreover in Table 3 data are given of the total amount of silver coated (expressed as the equivalent amount of silver nitrate), the water absorption and the scratch resistance of freshly prepared materials and of the materials stored for 2 hours at 57° C. and 34% RH . For the determination of the scratch resistance the hydrophilic layers of the materials were swollen in demineralized water of 20° C., whereupon the material was loaded with a continuously increasing pressure of a steel bullet while in the mean time moving the material relatively thereto. The value of the pressure was noted at the moment the material was scratched. The higher the value, the better the scratch resistance.

As a comparitive material STRUCTURIX D4p, an Agfa-Gevaert trademarked product, was taken as a practical material used for non-destructive testing purposes, the silver halide crystals of which are silver bromoiodide emulsions containing 1 mol % of iodide ions, built in homogeneously in the silver halide crystals having a round-off cubic habit and a crystal diameter of about 0.30 μm.

The comparative film STRUCTURIX D4p was run in an automatic machine processing cycle, being a STRUCTURIX NDT-M machine marketed by Agfa-Gevaert and processed with an adapted processing speed at 28° C. In the automatic processing machine the D4p material was run in the commercially available Agfa-Gevaert NDT-developer G135 and NDT-fixer G334.

TABLE 1

| | Exposure: 235 kV | | | | | |
|---|---|---|---|---|---|---|
| Sample No. | Fog | log K | G | Fog 57° C./34 RH | log K 57° C./34 RH | G 57° C./34 RH |
| 1 (inv.) | 0.25 | 1.99 | 5.06 | 0.29 | 2.00 | 5.11 |
| D4p (comp.) | 0.18 | 1.96 | 5.28 | 0.18 | 1.89 | 5.11 |

As can be seen from Table 1 it is possible to get a comparable sensitometry with the materials according to this invention and with the comparative STRUCTURIX D4p material, for the freshly prepared material and for the stored material as well.

TABLE 2

| | Exposure: 86 kV | | | | | |
|---|---|---|---|---|---|---|
| Sample No. | Fog | log K | G | Fog 57° C./34 RH | log K 57° C./34 RH | G 57° C./34 RH |
| 1 (inv.) | 0.24 | 1.83 | 5.39 | 0.30 | 1.83 | 4.83 |
| D4p (comp.) | 0.21 | 1.82 | 4.83 | 0.21 | 1.79 | 4.83 |

As can be seen from Table 2 it is possible to get an appropriate sensitometry with the materials according to this invention in comparison with the comparative STRUCTURIX D4p material, for the freshly prepared material and for the stored material as well.

TABLE 3

| Scratch resistance (S.R.); water absorption (WAT.ABS.); coated Ag amount/sq.m. | | | |
|---|---|---|---|
| Sample No. | S.R. 57° C./34RH | WAT.ABS. 37° C./34RH | Coated Ag/m$^2$ |
| 1 (inv.) | 625 | 41.6 | 20.6 |
| D4p (comp.) | 1125 | 44.5 | 21.0 |

Table 3 illustrates a remarkably lower scratch resistance for the materials according to this invention if compared with the comparative material. Nevertheless the water absorption is comparable for a same total amount of silver coated per square meter.

We claim:

1. A silver halide photographic material for industrial radiography comprising a film support and on one or both sides thereof a gelatino silver halide emulsion layer which is characterized in that said gelatino silver halide emulsion layer comprises as silver halide silver chloride or silver chlorobromide wherein an amount of bromide is not more than 10 mole %; has a gelatin to silver halide (expressed as an equivalent amount of silver nitrate) ratio from 0.2 to 0.6 and a total amount 6f silver halide coated from 11 g to 35 g per m$^2$ and in that the said photographic material has been forehardened to such an extent that when it is immersed in demineralized water of 25° C. for 3 minutes there is not absorbed more than 3.0 g of water per gram of gelatin, wherein said material further comprises a dihydroxybenzene compound and a 3-pyrazolidine-1-one compound as developing agents.

2. Method for developing a radiographically exposed photographic material according to claim 1, comprising the step of contacting the exposed photographic material with an aqueous alkaline liquid, called activator liquid, being initially substantially free from developing agent(s), having a pH value of at least 10 and containing a primary and/or secondary amine.

3. Method according to claim 2, wherein said aqueous alkaline liquid has a pH in the range from 1 to 14.

4. Method according to claim 2, wherein said solution contains an aliphatic primary diamine and a primary or secondary alkanol amine containing an alkylene chain of no more than 3 carbon atoms.

5. Method according to claim 2, wherein said solution contains an amine selected from the group consisting of:

$CH_3—NH—C_2H_4OH$ $H_2NCH_2CH_2NH_2$ $NH_2—CH_2CH_2OH$ $(CH_3)_2—CH—NH_2$

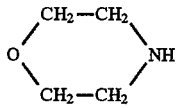

$H_2N—(CH_2CH_2NH)_3—CH_2—CH_2—NH_2$ $NH_2—(CH_2)_3—NH(CH_2)_2—OH$, and $NH(CH_2CH_2OH)_2$.

6. Method according to claim 2, wherein said amine is present in the activator liquid in a concentration in a range of 0.1 g/l to 100 g/l.

7. Method according to claim 2, wherein the activator liquid contains an anti-oxidizing agent to protect the amine (s) against aerial oxidation.

8. Method according to claim 2, wherein at least one of said developing agents is present in a hydrophilic colloid layer in waterpermeable relationship with the silver halide emulsion layer.

9. Method according to claim 2, wherein said developing agents are used in a molar ratio of dihydroxybenzene to 3-pyrazolidine-1-one of from 2/1 to 10/1.

10. Method according to claim 9, wherein the material comprises as dihydroxybenzene compound hydroquinone in an amount of from 0.05 to 0.5 g for a coverage of silver halide equivalent with 1 g of silver nitrate.

* * * * *

UNITED STATES PATENT AND TRADEMARK OFFICE

CERTIFICATE OF CORRECTION

PATENT NO. : 5,660,966

DATED : August 26, 1997

INVENTOR(S) : Peter Willems et al

It is certified that error appears in the above-indentified patent and that said Letters Patent is hereby corrected as shown below:

Claim 3, column 10, line 54, "1 to 14" should read -- 12 to 14 --.

Signed and Sealed this

Second Day of June, 1998

Bruce Lehman

*Attest:*

BRUCE LEHMAN

*Attesting Officer*

*Commissioner of Patents and Trademarks*